US009284690B2

(12) United States Patent
Huang et al.

(10) Patent No.: US 9,284,690 B2
(45) Date of Patent: Mar. 15, 2016

(54) WATER- AND OIL-REPELLENT AGENT

(71) Applicant: TAIWAN FLUORO TECHNOLOGY CO., LTD., Taichung (TW)

(72) Inventors: Jo-Yu Huang, Taichung (TW); Ren-Ren Chiou, New Taipei (TW); Jih-Hsih Ho, Taichung (TW)

(73) Assignee: Taiwan Fluoro Technology Co., Ltd., Taichung (TW)

( * ) Notice: Subject to any disclaimer, the term of this patent is extended or adjusted under 35 U.S.C. 154(b) by 0 days.

(21) Appl. No.: 14/320,937

(22) Filed: Jul. 1, 2014

(65) Prior Publication Data

US 2016/0002857 A1 Jan. 7, 2016

(51) Int. Cl.

| | |
|---|---|
| ***C08L 33/16*** | (2006.01) |
| ***D21H 21/16*** | (2006.01) |
| ***D21H 17/40*** | (2006.01) |

(52) U.S. Cl.

CPC ..... *D21H 21/16* (2013.01); *D21H 17/40* (2013.01)

(58) Field of Classification Search

CPC ..... C08L 33/16; C08L 33/10; C08L 33/06; C08L 2660/04; C09D 133/00; D06M 15/277; D06M 15/19

See application file for complete search history.

(56) References Cited

U.S. PATENT DOCUMENTS

| | | | | | |
|---|---|---|---|---|---|
| 3,532,659 | A | * | 10/1970 | Hager et al. | 524/805 |
| 3,544,663 | A | * | 12/1970 | Hauptschein et al. | 525/200 |
| 5,021,501 | A | * | 6/1991 | Ohmori et al. | 524/544 |
| 2012/0037835 | A1 | * | 2/2012 | Otozawa et al. | 252/8.57 |

* cited by examiner

*Primary Examiner* — Nathan M Nutter

(74) *Attorney, Agent, or Firm* — Tracy M. Heims; Apex Juris, pllc.

(57) ABSTRACT

A water- and oil-repellent agent is produced by blending a fluorine-containing polymer and a fluorine-free polymer, wherein the fluorine-free polymer is 30-70% by weight of the total of the water- and oil-repellent agent, the fluorine-containing polymer is polymerized by a fluorine-containing monomer, a non-fluorinated branched monomer, a non-fluorinated crosslinking monomer, and an olefin monomer, and wherein the fluorine-containing monomer, the non-fluorinated branched monomer, the non-fluorinated crosslinking monomer, and the olefin monomer are 45-80%, 1-30%, 1-10%, and 10-50% by weight of the total of the fluorine-containing polymer respectively- and the fluorine-free polymer is polymerized by a non-fluorinated non-crosslinking monomer, a non-fluorinated crosslinking monomer, and an olefin monomer, wherein the non-fluorinated non-crosslinking monomer, the non-fluorinated crosslinking monomer, and the olefin monomer are 45-80%, 1-30%, and 10-50% by weight of the total of the fluorine-free polymer respectively whereby, the agent reduces adhesion on a roller, and reduces environmental impact due to reduced fluorine usage.

8 Claims, No Drawings

WATER- AND OIL-REPELLENT AGENT

BACKGROUND OF THE INVENTION

1. Technical Field

The present invention relates generally to water- and oil-repellent agent, and more particularly to a type of water- and oil-repellent agent which comprises a fluorine-containing polymer and a fluorine-free polymer.

2. Description of Related Art

Fluorine-containing compounds are widely applied as surface treatment agents for several kinds of materials, such as textiles, wood, metal, concrete, etc. This type of surface treatment agents have better waterproofing and oil-proofing effect on surfaces of textiles, including natural fibers, synthetic fibers, and semi-synthetic fibers. In conventional ways, perfluoroalkyl ethyl acrylate of the formula $H_2C{=}C(X)C({=}O){-}Y{-}Z{-}R_f$ is suitable for manufacturing waterproofing and oil-proofing surface treatment agents if fluoroalkyl represented by $R_f$ contains 8 carbon atoms. On the other hand, the waterproofing and oil-proofing effect gets poorer if fluoroalkyl represented by $R_f$ contains only 4 to 6 carbon atoms. In such cases, it has to additionally apply vinyl chloride or vinylidene chloride to enhance the effect. Although the mixtures which are made by adding olefin monomer of vinyl chloride or vinylidene chloride into perfluoroalkyl ethyl acrylate can provide textile fibers with good waterproofing and water tolerance effect, the surface treatment agents may cause adhesion problem on rollers which are used for processing the fibers.

BRIEF SUMMARY OF THE INVENTION

In view of the above, the primary objective of the present invention is to provide a water- and oil-repellent agent, which has good water- and oil-repellent effect, and also eases the adhesion problem happened on rollers. Furthermore, environmental impact is reduced due to fewer usage of fluorine.

The water- and oil-repellent agent provided in the present invention includes a fluorine-containing polymer and a fluorine-free polymer, wherein the fluorine-containing polymer is polymerized at least by a fluorine-containing monomer, a non-fluorinated branched monomer, a non-fluorinated crosslinking monomer, and an olefin monomer; the fluorine-free polymer is polymerized at least by a non-fluorinated non-crosslinking monomer, a non-fluorinated crosslinking monomer, and an olefin monomer.

In an embodiment, the fluorine-containing monomer is of the formula

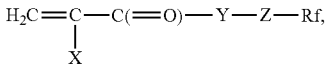

where X is hydrogen atom, monovalent organic group, halogen atom, linear or branched fluoroalkyl with 1 to 21 carbon atoms, or cyano; Y is oxygen atom, sulfur atom, or secondary amine; Z is straight chain alkane, divalent organic group, aromatics or cycloaliphatic of which carbon number is 6 to 18, or aliphatic groups of which carbon number is 1 to 10; and $R_f$ is linear or branched fluoroalkyl of which carbon number is 4 to 6.

In an embodiment, the non-fluorinated non-crosslinking monomer is of the formula H2C═CACOOA', where A is hydrogen atom or methyl; A' is alkyl of the formula $C_nH_{2n+1}$, where n=3-30.

In an embodiment, the non-fluorinated branched monomer is of the formula $H_2C{=}CACOOA'$, where A is hydrogen atom or methyl; A' is branched primary to tertiary alkyl, and is of the formula $C_nH_m$, where n=3-10, m=7-30.

In an embodiment, the non-fluorinated branched monomer is selected from at least one member of the group consisting of tert-Butyl methacrylate, iso-butyl methacrylate, 2-ethylhexyl methacrylate, n-nonyl acrylate, isobornyl acrylate, isobornyl methacrylate, cyclohexyl methacrylate, benzyl methacrylate, and benzyl acrylate.

In an embodiment, the non-fluorinated crosslinking monomer has two or more reactive functional groups.

In an embodiment, the non-fluorinated crosslinking monomer is selected from at least one member of the group consisting of 3-chloro-2-hydroxypropyl methacrylate, 2-hydroxyethyl methacrylate, 2-hydroxypropyl methacrylate, epoxypropyl methacrylate, ethylene glycol methyl ether methacrylate, ethyl methacrylate, diacetone acrylamide, 4-hydroxybutyl acrylate, 1,4-cyclohexane dimethanol monoacrylate, and 4-hydroxybutyl acrylate glycidyl ether.

In an embodiment, the olefin monomer is halogenated olefin monomer.

In an embodiment, the olefin monomer is vinyl chloride or vinylidene chloride.

In an embodiment, the fluorine-free polymer is 30-70% by weight.

In an embodiment, the fluorine-containing monomer is 45-80% by weight.

In an embodiment, the non-fluorinated branched monomer of the fluorine-containing polymer is 1-30% by weight.

In an embodiment, the non-fluorinated crosslinking monomer of the fluorine-containing polymer is 1-10% by weight.

In an embodiment, the olefin monomer of the fluorine-containing polymer is 10-50% by weight.

In an embodiment, the non-fluorinated non-crosslinking monomer of the fluorine-free polymer is 45-80% by weight.

In an embodiment, the non-fluorinated crosslinking monomer of the fluorine-free polymer is 1-30% by weight.

In an embodiment, the olefin monomer of the fluorine-free polymer is 10-50% by weight.

In an embodiment, the water- and oil-repellent agent is applied for processing fiber products.

In an embodiment, the water- and oil-repellent agent is water-based.

BRIEF DESCRIPTION OF THE SEVERAL VIEWS OF THE DRAWINGS

None.

DETAILED DESCRIPTION OF THE INVENTION

The present invention provides a water- and oil-repellent agent which is produced by blending a fluorine-containing polymer and a fluorine-free polymer, wherein the fluorine-containing polymer is polymerized by a fluorine-containing monomer, a non-fluorinated branched monomer, a non-fluorinated crosslinking monomer, and an olefin monomer; the fluorine-free polymer is polymerized by non-fluorinated non-crosslinking monomer, non-fluorinated crosslinking monomer, and olefin monomer.

The fluorine-containing monomer is of the formula

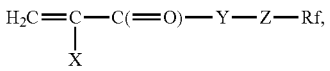

where X is hydrogen atom, monovalent organic group, halogen atom, linear or branched fluoroalkyl with 1 to 21 carbon atoms, or cyano; Y oxygen atom, sulfur atom, or secondary amine; Z is straight chain alkane, divalent organic group, aromatics or cycloaliphatic of which carbon number is 6 to 18, or aliphatic groups of which carbon number is 1 to 10; $R_f$ is linear or branched fluoroalkyl of which carbon number is 4 to 6. Here are some examples of $R_f$ listed below, but please be noted that they are not limitations of the present invention:

$CF_3(CF_2)_3(CH_2)_2OCOCH{=}CH_2$ $CF_3(CF_2)_5(CH_2)_2OCOCH{=}CH_2$ $CF_3(CF_2)_3(CH_2)_2OCOC(CH_3){=}CH_2$ $CF_3(CF_2)_5(CH_2)_2OCOC(CH_3){=}CH_2$

-continued $F_2HC(CF_2)_3CH_2OCOCH{=}CH_2$ $F_2HC(CF_2)_3CH_2OCOC(CH_3){=}CH_2$ $F_2HC(CF_2)_3CH_2CH_2OCOCH{=}CH_2$ $F_2HC(CF_2)_3CH_2CH_2OCOC(CH_3){=}CH_2$ $F_2HC(CF_2)_5CH_2OCOCH{=}CH_2$ $F_2HC(CF_2)_5CH_2OCOC(CH_3){=}CH_2$ $F_2HC(CF_2)_5CH_2CH_2OCOCH{=}CH_2$ $F_2HC(CF_2)_5CH_2CH_2OCOCH_2(CH){=}CH_2$ The non-fluorinated non-crosslinking monomer is of the formula H2C═CACOOA', where A is hydrogen atom or methyl, and A' is alkyl of the formula $C_nH_{2n+1}$, where n=3-30.

The non-fluorinated branched monomer is of the formula H2C═CACOOA', where A is hydrogen atom or methyl; A' is branched primary to tertiary alkyl, and is of the formula $C_nH_m$, where n=3-10, m=7-30. There are several functional non-fluorinated branched monomers listed in Table 1, and the water- and oil-repellent agent of the present invention could contain one or more monomers mentioned here. Please be noted that what are listed in Table 1 are not limitations of the present invention.

TABLE 1

Non-fluorinated branched monomers

| Abbr. | Name | Chemical Structure |
|---|---|---|
| TBMA | tert-butyl methacrylate | 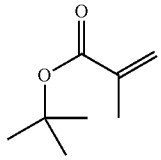 |
| IBMA | iso-butyl methacrylate | 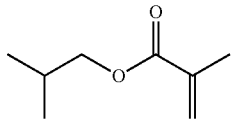 |
| EHMA | 2-ethylhexyl methacrylate | 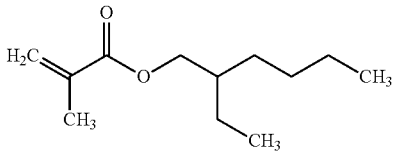 |
| TMHA | n-nonyl acrylate | 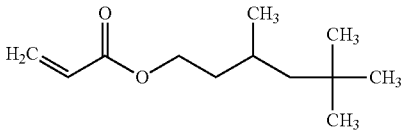 |
| IBOA | isobornyl acrylate | 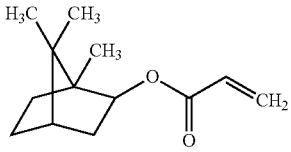 |

TABLE 1-continued

| Non-fluorinated branched monomers | | |
|---|---|---|
| Abbr. | Name | Chemical Structure |
| IBOMA | isobornyl methacrylate | |
| CHMA | cyclohexyl methacrylate | |
| BZMA | benzyl methacrylate | |

In addition to the monomers listed in Table 1, benzyl acrylate and cyclohexyl methacrylate can be selected too.

The non-fluorinated crosslinking monomer has two or more reactive functional groups. There are several functional non-fluorinated crosslinking monomers listed in Table 2, and the water- and oil-repellent agent of the present invention could contain one or more monomers mentioned above. Please be noted that what are listed in Table 2 are not limitations of the present invention.

TABLE 2

| Non-fluorinated crosslinking monomers | | |
|---|---|---|
| Abbr. | Name | Chemical Structure |
| CHPMA | 3-chloro-2-hydroxypropyl methacrylate | |
| HEMA | 2-hydroxyethyl methacrylate | |
| HPMA | 2-hydroxypropyl methacrylate | |
| GMA | epoxypropyl methacrylate | |
| MEMA | ethylene glycol methyl ether methacrylat | |

TABLE 2-continued

| Non-fluorinated crosslinking monomers | | |
|---|---|---|
| Abbr. | Name | Chemical Structure |
| EEMA | ethyl methacrylate | 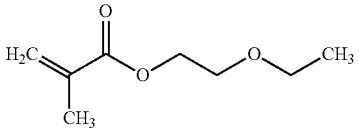 |
| DAAM | diacetone acrylamide | 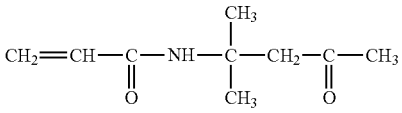 |
| 4HBA | 4-hydroxybutyl acrylate | 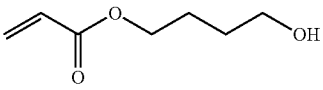 |
| CHDMMA | 1,4-cyclohexane dimethanol monoacrylate | 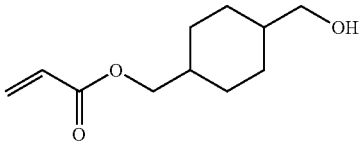 |
| 4HBAGE | 4-hydroxybutyl acrylate glycidyl ether | 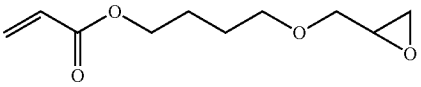 |

The non-fluorinated crosslinking monomer is preferably to be halogenated olefin monomer. For example, it can be vinyl chloride or vinylidene chloride.

Comparative Example 1

As shown in Table 3, blend 75 g of 6 FMA, 15 g of IBOA, 2 g of GLA, 6 g of DAAM, 0.75 g of 1-dodecanethiol, 43.5 g of dipropylene glycol monomethyl ether, and 300 g of deionized water under 50° C. for 20 minutes; evenly apply 40 MPa of pressure to produce a stable homogeneous emulsion, of which penetrability has to be larger than 15% under test with UV of wavelength 650 nm; pour the homogeneous emulsion into a 1 liter four-necked glass reaction flask, and add in 0.8 g of 2,2'-azobis(-amidinopropane)dihydrochloride and 45 g of VDC for reaction under 60° C. for 6 hours. An aqueous dispersion of acrylic polymer is then obtained.

Comparative Example 2

As shown in Table 3, blend 15 g of IBOA, 2 g of GLA, 6 g of DAAM, 0.75 g of 1-dodecanethiol, 43.5 g of dipropylene glycol monomethyl ether, and 300 g of deionized water under 50° C. for 20 minutes; evenly apply 40 MPa of pressure to produce a stable homogeneous emulsion; pour the homogeneous emulsion into a 1 liter four-necked glass reaction flask, and add in 0.8 g of 2,2'-azobis(-amidinopropane)dihydrochloride and 45 g of VDC for reaction under 60° C. for 6 hours. An aqueous dispersion without fluorine-containing polymers is then obtained.

Comparative Example 3

As shown in Table 3, blend 15 g of SA, 2.5 g of GMA, 6 g of DAAM, 0.75 g of 1-dodecanethiol, 43.5 g of dipropylene glycol monomethyl ether, and 300 g of deionized water under 50° C. for 20 minutes; evenly apply 40 MPa of pressure to produce a stable homogeneous emulsion; pour the homogeneous emulsion into a 1 liter four-necked glass reaction flask, and add in 0.8 g of 2,2'-azobis(-amidinopropane)dihydrochloride and 45 g of VDC for reaction under 60° C. for 6 hours. An aqueous dispersion without fluorine-containing polymers is then obtained.

Production Example 1

As shown in Table 3, blend 15 g of IBOA, 2 g of GLA, 6 g of DAAM, 0.75 g of 1-dodecanethiol, 43.5 g of dipropylene glycol monomethyl ether, and 300 g of deionized water under 50° C. for 20 minutes; evenly apply 40 MPa of pressure to produce a stable homogeneous emulsion, of which penetrability has to be larger than 15% under test with UV of wavelength 650 nm; pour the homogeneous emulsion into a 1 liter four-necked glass reaction flask, and add in 0.8 g of 2,2'-azobis(-amidinopropane)dihydrochloride and 45 g of VDC for reaction under 60° C. for 6 hours. An aqueous dispersion without fluorine-containing polymers is then obtained. Blend said aqueous dispersion into the aqueous dispersion of acrylic polymer of Comparative Example 1 in a 30 to 70 ratio to obtain an aqueous dispersion containing fluorine-containing and fluorine-free polymers.

Production Example 2

As shown in Table 3, blend 15 g of SA, 2.5 g of GMA, 6 g of DAAM, 0.75 g of 1-dodecanethiol, 43.5 g of dipropylene glycol monomethyl ether, and 300 g of deionized water under 50° C. for 20 minutes; evenly apply 40 MPa of pressure to produce a stable homogeneous emulsion; pour the homogeneous emulsion into a 1 liter four-necked glass reaction flask, and add in 0.8 g of 2,2'-azobis(-amidinopropane)dihydrochloride and 45 g of VDC for reaction under 60° C. for 6 hours. An aqueous dispersion without fluorine-containing polymers is then obtained. Blend said aqueous dispersion into the aqueous dispersion of acrylic polymer of Comparative Example 1 in a 30 to 70 ratio to obtain an aqueous dispersion containing fluorine-containing and fluorine-free polymers.

Production Example 3

As shown in Table 3, blend 75 g of 6 FMA, 15 g of IBOA, 2.5 g of GMA, 6 g of DAAM, 0.75 g of 1-dodecanethiol, 43.5 g of dipropylene glycol monomethyl ether, and 300 g of deionized water under 50° C. for 20 minutes; evenly apply 40 MPa of pressure to produce a stable homogeneous emulsion; pour the homogeneous emulsion into a 1 liter four-necked glass reaction flask, and add in 0.8 g of 2,2'-azobis(-amidinopropane)dihydrochloride and 28 g of VDC for reaction under 60° C. for 6 hours. An aqueous dispersion of acrylic polymer is then obtained. Blend the aqueous dispersion without fluorine-containing polymers of Comparative Example 2 into said aqueous dispersion of acrylic polymer in a 30 to 70 ratio to obtain an aqueous dispersion containing fluorine-containing and fluorine-free polymers.

Production Example 4

As shown in Table 3, blend 75 g of 6 FMA, 24 g of IBOA, 2.5 g of GMA, 6 g of DAAM, 0.75 g of 1-dodecanethiol, 43.5 g of dipropylene glycol monomethyl ether, and 300 g of deionized water under 50° C. for 20 minutes; evenly apply 40 MPa of pressure to produce a stable homogeneous emulsion; pour the homogeneous emulsion into a 1 liter four-necked glass reaction flask, and add in 0.8 g of 2,2'-azobis(-amidinopropane)dihydrochloride and 45 g of VDC for reaction under 60° C. for 6 hours. An aqueous dispersion of acrylic polymer is then obtained. Blend the aqueous dispersion without fluorine-containing polymers of Comparative Example 2 into said aqueous dispersion of acrylic polymer in a 30 to 70 ratio to obtain an aqueous dispersion containing fluorine-containing and fluorine-free polymers.

Production Example 5

As shown in Table 3, blend 100 g of 6 FMA, 15 g of IBOA, 2.5 g of GMA, 6 g of DAAM, 0.75 g of 1-dodecanethiol, 43.5 g of dipropylene glycol monomethyl ether, and 300 g of deionized water under 50° C. for 20 minutes; evenly apply 40 MPa of pressure to produce a stable homogeneous emulsion; pour the homogeneous emulsion into a 1 liter four-necked glass reaction flask, and add in 0.8 g of 2,2'-azobis(-amidinopropane)dihydrochloride and 45 g of VDC for reaction under 60° C. for 6 hours. An aqueous dispersion of acrylic polymer is then obtained. Blend the aqueous dispersion without fluorine-containing polymers of Comparative Example 2 into said aqueous dispersion of acrylic polymer in a 30 to 70 ratio to obtain an aqueous dispersion containing fluorine-containing and fluorine-free polymers.

Production Example 6

As shown in Table 3, blend 100 g of 6 FMA, 15 g of IBOA, 21.5 g of EHMA, 8.5 g of DAAM, 0.75 g of 1-dodecanethiol, 43.5 g of dipropylene glycol monomethyl ether, and 350 g of deionized water under 50° C. for 20 minutes; evenly apply 40 MPa of pressure to produce a stable homogeneous emulsion; pour the homogeneous emulsion into a 1 liter four-necked glass reaction flask, and add in 1 g of 2,2'-azobis(-amidinopropane)dihydrochloride and 30 g of VDC for reaction under 60° C. for 6 hours. An aqueous dispersion of acrylic polymer is then obtained. Blend the aqueous dispersion without fluorine-containing polymers of Comparative Example 2 into said aqueous dispersion of acrylic polymer in a 30 to 70 ratio to obtain an aqueous dispersion containing fluorine-containing and fluorine-free polymers.

Production Example 7

As shown in Table 3, blend 100 g of 6 FMA, 15 g of IBOA, 8.5 g of DAAM, 0.75 g of 1-dodecanethiol, 43.5 g of dipropylene glycol monomethyl ether, and 350 g of deionized water under 50° C. for 20 minutes; evenly apply 40 MPa of pressure to produce a stable homogeneous emulsion; pour the homogeneous emulsion into a 1 liter four-necked glass reaction flask, and add in 1 g of 2,2'-azobis(-amidinopropane) dihydrochloride and 30 g of VDC for reaction under 60° C. for 6 hours. An aqueous dispersion of acrylic polymer is then obtained. Blend the aqueous dispersion without fluorine-containing polymers of Comparative Example 2 into said aqueous dispersion of acrylic polymer in a 30 to 70 ratio to obtain an aqueous dispersion containing fluorine-containing and fluorine-free polymers.

Production Example 8

As shown in Table 3, blend 75 g of 6 FMA, 24 g of IBOA, 3.5 g of GMA, 2.2 g of CHMA, 6.5 g of DAAM, 0.75 g of 1-dodecanethiol, 43.5 g of dipropylene glycol monomethyl ether, and 350 g of deionized water under 50° C. for 20 minutes; evenly apply 40 MPa of pressure to produce a stable homogeneous emulsion; pour the homogeneous emulsion into a 1 liter four-necked glass reaction flask, and add in 1 g of 2,2'-azobis(-amidinopropane)dihydrochloride and 28 g of VDC for reaction under 60° C. for 6 hours. An aqueous dispersion of acrylic polymer is then obtained. Blend the aqueous dispersion without fluorine-containing polymers of Comparative Example 2 into said aqueous dispersion of acrylic polymer in a 30 to 70 ratio to obtain an aqueous dispersion containing fluorine-containing and fluorine-free polymers.

Production Example 9

As shown in Table 3, blend 75 g of 6 FMA, 24 g of IBOA, 2.5 g of GMA, 6 g of DAAM, 0.75 g of 1-dodecanethiol, 43.5 g of dipropylene glycol monomethyl ether, and 300 g of deionized water under 50° C. for 20 minutes; evenly apply 40 MPa of pressure to produce a stable homogeneous emulsion; pour the homogeneous emulsion into a 1 liter four-necked glass reaction flask, and add in 0.8 g of 2,2'-azobis(-amidinopropane)dihydrochloride and 45 g of VDC for reaction under 60° C. for 6 hours. An aqueous dispersion of acrylic polymer is then obtained. Blend the aqueous dispersion without fluorine-containing polymers of Comparative Example 3 into said aqueous dispersion of acrylic polymer in a 30 to 70 ratio to obtain an aqueous dispersion containing fluorine-containing and fluorine-free polymers.

Production Example 10

As shown in Table 3, blend 100 g of 6 FMA, 15 g of IBOA, 21.5 g of EHMA, 8.5 g of DAAM, 0.75 g of 1-dodecanethiol, 43.5 g of dipropylene glycol monomethyl ether, and 350 g of deionized water under 50° C. for 20 minutes; evenly apply 40 MPa of pressure to produce a stable homogeneous emulsion;

pour the homogeneous emulsion into a 1 liter four-necked glass reaction flask, and add in 1 g of 2,2'-azobis(-amidinopropane)dihydrochloride and 30 g of VDC for reaction under 60° C. for 6 hours. An aqueous dispersion of acrylic polymer is then obtained. Blend the aqueous dispersion without fluorine-containing polymers of Comparative Example 3 into said aqueous dispersion of acrylic polymer in a 30 to 70 ratio to obtain an aqueous dispersion containing fluorine-containing and fluorine-free polymers.

It is worth mentioning that the aforementioned embodiments are all blended in a 30 to 70 ratio, but they can be blended in different ratios, which are preferred from 30 to 70 ratio to 70 to 30 ratio. In other words, the proportion of the fluorine-free polymers can be between 30% and 70%.

TABLE 3

Formula of Comparative Examples and Production Examples (unit: gram)

| | Comparative Example | | | Production Example | | | | | | | | | | |
|---|---|---|---|---|---|---|---|---|---|---|---|---|---|---|
| | 1 | 2 | 3 | 1 | 2 | 3 | 4 | 5 | 6 | 7 | 8 | 9 | 10 | 11 |
| perfluorooctyl methacrylate (6FMA) | 75 | — | — | — | — | 75 | 75 | 100 | 100 | 100 | 75 | 75 | 100 | 75 |
| isobornyl acrylate (IBOA) | 15 | 15 | — | 15 | — | 15 | 24 | 15 | 15 | 15 | 24 | 24 | 15 | 24 |
| octadecyl acrylate (SA) | — | — | 15 | — | 15 | — | — | — | — | — | — | — | — | — |
| 2-ethylhexyl methacrylate (EHMA) | — | — | — | — | — | — | — | — | 21.5 | — | — | — | 21.5 | — |
| epoxypropyl methacrylate (GMA) | — | — | 2.5 | — | 2.5 | 2.5 | 2.5 | 2.5 | — | — | 3.5 | 2.5 | — | 3.5 |
| 2,3-dihydroxypropyl methacrylate (GLA) | 2 | 2 | — | 2 | — | — | — | — | — | — | — | — | — | — |
| cyclohexyl methacrylate (CHMA) | — | — | — | — | — | — | — | — | — | — | 2.2 | — | — | 2.2 |
| diacetone acrylamide (DAAM) | 6 | 6 | 6 | 6 | 6 | 6 | 6 | 6 | 8.5 | 8.5 | 6.5 | 6 | 8.5 | 6.5 |
| vinylidene chloride (VDC) | 45 | 45 | 45 | 45 | 45 | 28 | 45 | 45 | 30 | 30 | 28 | 45 | 30 | 28 |
| 1-dodecanethiol | 0.75 | 0.75 | 0.75 | 0.75 | 0.75 | 0.75 | 0.75 | 0.75 | 0.75 | 0.75 | 0.75 | 0.75 | 0.75 | 0.75 |
| dipropylene glycol monomethyl ether | 43.5 | 43.5 | 43.5 | 43.5 | 43.5 | 43.5 | 43.5 | 43.5 | 43.5 | 43.5 | 43.5 | 43.5 | 43.5 | 43.5 |
| 2,2'-azobis(-amidinopropane) dihydrochloride | 0.8 | 0.8 | 0.8 | 0.8 | 0.8 | 0.8 | 0.8 | 0.8 | 1 | 1 | 1 | 0.8 | 1 | 1 |
| deionized water | 300 | 300 | 300 | 300 | 300 | 300 | 300 | 300 | 350 | 350 | 350 | 300 | 350 | 350 |

Production Example 11

As shown in Table 3, blend 75 g of 6 FMA, 24 g of IBOA, 3.5 g of GMA, 2.2 g of CHMA, 6.5 g of DAAM, 0.75 g of 1-dodecanethiol, 43.5 g of dipropylene glycol monomethyl ether, and 350 g of deionized water under 50° C. for 20 minutes; evenly apply 40 MPa of pressure to produce a stable homogeneous emulsion; pour the homogeneous emulsion into a 1 liter four-necked glass reaction flask, and add in 1 g of 2,2'-azobis(-amidinopropane)dihydrochloride and 28 g of VDC for reaction under 60° C. for 6 hours. An aqueous dispersion of acrylic polymer is then obtained. Blend the aqueous dispersion without fluorine-containing polymers of Comparative Example 3 into said aqueous dispersion of acrylic polymer in a 30 to 70 ratio to obtain an aqueous However, what is listed in Table 3 is not a limitation of the present invention. In other embodiments, for the fluorine-containing polymer, the fluorine-containing monomer is preferably to be between 45% and 80% by weight, the non-fluorinated branched monomer is preferably to be between 1% and 30% by weight, the non-fluorinated crosslinking monomer is preferably to be between 1% and 10% by weight, and the olefin monomer is preferably to be between 10% and 50% by weight. In the other hand, for the fluorine-free polymer, the non-fluorinated non-crosslinking monomer is preferably to be between 45% and 80% by weight, the non-fluorinated crosslinking monomer is preferably to be between 1% and 30% by weight, and the olefin monomer is preferably to be between 10% and 50% by weight.

<Evaluation of Water-Repellent Effect of Water-Repellent Agents>

An aqueous dispersion of acrylic polymer can be applied on synthetic fibers with a conventional method of processing textiles. For example, percentage thereof can be between 0.5% and 25% by weight, or between 1% and 10% by weight, or, preferably, between 1% and 5%. The fibers can be immersed in the aqueous dispersion in advance, or can be pad dyed to press out the aqueous dispersion. The fibers can be dried by heating under, as an example, the condition between 100° C. and 200° C. for 60 to 90 seconds, wherein the condition is preferably to be between 150° C. and 200° C. for 60 to 90 seconds. The water-repellent effect can be provided in this way.

Typically, the fibers can be those of synthetic fiber cloth, which includes weaving fabric, knitted fabric, and nonwoven fabric, all kinds of clothes, blankets, or intermediate textile products. The textile products can be synthetic fibers, such as polyester, polyamide, or synthetic fibers of the kinds of acrylic acid, or can be textile mixtures of natural and synthetic fibers. The present invention provides particular high effective water-repellent effect if it is applied on synthetic fibers cloth such as Nylon or polyester. Compared to untreated cloth, the fiber cloth that is treated with the water- and oil-repellent agent of the present invention has good water-repellent effect, and the tactile impression is improved as well.

In practice, the fibers can be those of the kinds of paper, which means, the water- and oil-repellent agent of the present invention can be applied on papers that are going through different processing stages, such as preformed or drying stages.

The surface treatment agent of the present invention is preferably to be in solution form. Conventional surface treatment agents typically contain fluorine-containing polymers and substrate mediums such as organic solvents or water. The surface treatment agents provided in the present invention have 0.1% to 50% of fluorine-containing polymers by weight, wherein 5% to 30% is preferable. The surface treatment agents provided in the present invention can be applied by immersing materials within. Generally, before immersing materials and having the materials dried by heating, surface treatment agents are diluted with organic solvents or water. If necessary, a manufacturer can further add mothproofing agent, softening agent, antibacterial agent, flame resisting agent, antistatic agent, colorant fixing agent, anticorrosive agent etc. in surface treatment agents.

To apply the surface treatment agents provided in the present invention on fiber cloth materials, leather materials, or glass materials, fluorine-containing polymers of the solution in which the materials immersed can be 0.01% to 20% by weight, wherein 0.05% to 5% is preferable. As in the examples provided in the present invention, it is 0.05% to 10% by weight.

The surface treatment agents provided in the present invention provides better water-repellent effect on textiles, which include natural fibers (animal fibers or vegetative fibers, such as cotton, hemp, wool, or silk), synthetic fibers (such as nylon, polyester, polyamide, polyvinyl alcohol, polyacrylonitrile, polyvinylchloride, and polypropylene), semi-synthetic fibers (such as rayon and acetate ester), inorganic fibers (such as glass fiber, carbon fiber, and asbestos fiber), and mixtures of the aforementioned fibers.

<Shower Water-Repellency Test (AATCC-22)>

Prepare a 250 ml plastic funnel which has a nozzle capable of spraying 250 ml of water for 20 to 30 seconds; prepare three 20 cm×20 cm specimens of materials which are going to be tested; place one of the specimens on a round specimen holder which has 15 cm diameter, and the specimen should have no wrinkling; place a sprayer at the center, and pour 250 ml water of room temperature into the plastic funnel; spray water on the specimen for 20 to 30 seconds; remove the specimen, and gently flip the specimen to shake off water drops; test another two specimens in the same way. Each specimen is scored from 0 to 100 according to its wetness, and the scoring standard is shown in Table 4. The test result is an average score of all three specimens.

TABLE 4

Scoring standard of water-repellent effect

| Water-Repellent Score | Descriptions |
|---|---|
| 100 | The surface of the specimen is completely dry |
| 90 | Little water drops are adhered on the surface of the specimen |
| 80 | Several water bodies are distributed on the surface of the specimen |
| 70 | Water bodies are on half of the surface of the specimen, and the specimen is slightly infiltrated |
| 50 | Water bodies are all over the surface of the specimen |
| 0 | The specimen is completely infiltrated with water |

<Washing Durability Test (AATCC-22)>

Select and record a washing condition and drying method, or follow the washing instructions provided by manufacturers;

Pour water into a washing machine to a predetermined level (about 68 L), and adjust the water temperature; Add 66±1 g of standard cleaner (Model: 1993AATCC, or of the same class), specimens, and a cloth which weights 1.8±0.1 Kg into the washing machine, and start the washing procedure;

Dry the specimens under a standard temperature and moisture condition, which is 20±2° C. and 65±2% R.H., for 4 hours after finishing the washing procedure.

TABLE 5

Test results of water-repellent, oil-repellent, and washing durability effect

| Evaluation | | Concen- | Comparative Example | | | Production Example | | | | | | | | | | |
|---|---|---|---|---|---|---|---|---|---|---|---|---|---|---|---|---|
| Methods | Cloth | tration | 1 | 2 | 3 | 1 | 2 | 3 | 4 | 5 | 6 | 7 | 8 | 9 | 10 | 11 |
| Water-Repellent | Polyester | 1% | 90 | 50 | 50 | 90 | 90 | 90 | 100 | 100 | 100 | 100 | 90 | 100 | 100 | 90 |
| Effect at Early | | 0.75% | 80 | 0 | 0 | 80 | 80 | 80 | 100 | 100 | 90 | 90 | 80 | 100 | 90 | 80 |
| Stage of | Nylon | 1% | 90 | 50 | 50 | 90 | 90 | 80 | 100 | 100 | 90 | 90 | 90 | 100 | 90 | 90 |
| Spraying | | 0.75% | 80 | 0 | 0 | 80 | 80 | 80 | 100 | 100 | 80 | 80 | 80 | 100 | 80 | 80 |
| Concentration of Working Solution for Washing Durability Test (%) | | | 2 | 2 | 2 | 2 | 2 | 2 | 2 | 2 | 2 | 2 | 2 | 2 | 2 | 2 |
| Forming Condition (° C./Second) | | | | | | | | | 170/60 | | | | | | | |
| Water-Repellent | Polyester | HL0 | 100 | 50 | 50 | 100 | 100 | 100 | 100 | 100 | 100 | 100 | 90 | 100 | 100 | 90 |
| Effect of Washing | | HL10 | 80 | 0 | 0 | 80 | 80 | 80 | 80 | 80 | 90 | 80 | 80 | 80 | 90 | 80 |
| Durability Test | | HL20 | 80 | 0 | 0 | 70 | 80 | 70 | 70 | 70 | 80 | 70 | 50 | 70 | 80 | 50 |
| Oil-Repellent | Polyester | HL0 | 5 | 1 | 1 | 4 | 5 | 3 | 2 | 3 | 4 | 3 | 3 | 2 | 4 | 3 |

TABLE 5-continued

Test results of water-repellent, oil-repellent, and washing durability effect

| Evaluation Methods | Cloth | Concentration | Comparative Example 1 | 2 | 3 | Production Example 1 | 2 | 3 | 4 | 5 | 6 | 7 | 8 | 9 | 10 | 11 |
|---|---|---|---|---|---|---|---|---|---|---|---|---|---|---|---|---|
| Effect of Washing Durability Test | | HL10 | 3 | 0 | 0 | 2 | 3 | 2 | 1 | 2 | 3 | 2 | 2 | 1 | 3 | 2 |
| | | HL20 | 2 | 0 | 0 | 2 | 2 | 0 | 0 | 1 | 2 | 1 | 1 | 0 | 2 | 1 |

<Test of Adhesive Status on the Rollers>

Place 4 g of surface treatment agent in a 250 ml beaker, and blend with 196 g of deionized water under 25° C. to form a solution; immerse textile materials into the solution; press out the solution with a padding machine which provides 3 kg pressure; judge the adhesion status on rollers of the padding machine during the textile materials are passing through.

o: completely clean on the rollers

Δ: adhered with little area on the rollers x: adhered with large area on the rollers The test is proceed with three specimens of textile materials.

TABLE 6

Adhesive status on the rollers

| | | Adhesive status on the rollers |
|---|---|---|
| Comparative Example | 1 | ○ |
| | 2 | ○ |
| | 3 | Δ |
| Production Example | 1 | ○ |
| | 2 | Δ |
| | 3 | Δ |
| | 4 | ○ |
| | 5 | ○ |
| | 6 | ○ |
| | 7 | ○ |
| | 8 | x |
| | 9 | ○ |
| | 10 | ○ |
| | 11 | x |

As we can see, the water- and oil-repellent agent of the present invention, which is produced by blending a fluorine-containing and a fluorine-free polymers, is able to provide good water- and oil-repellent effect. In more details, the fluorine-containing polymer is polymerized by at least a fluorine-containing monomer, a non-fluorinated branched monomer, a non-fluorinated crosslinking monomer, and an olefin monomer; the fluorine-free polymer is polymerized by at least non-fluorinated non-crosslinking monomer, non-fluorinated crosslinking monomer, and olefin monomer. The adhesion problem on the rollers can be eases as well. Furthermore, environmental impact is reduced due to fewer usage of fluorine of the water- and oil-repellent agent of the present invention.

It must be pointed out that the embodiments described above are only some preferred embodiments of the present invention. All equivalent formulas which employ the concepts disclosed in this specification and the appended claims should fall within the scope of the present invention.

What is claimed is:

1. A water- and oil-repellent agent, comprising:

a fluorine-containing polymer, which is polymerized at least by a fluorine-containing monomer, a non-fluorinated branched monomer, a non-fluorinated non-crosslinking, a non-fluorinated crosslinking monomer, and an olefin monomer;

wherein the fluorine-containing monomer is the formula

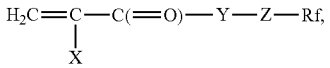

where

X is a hydrogen atom, a monovalent organic group, a halogen atom, a linear fluoroalkyl having 1 to 21 carbon atoms, a branched fluoroalkyl having 1 to 21 carbon atoms, or a cyano;

Y is an oxygen atom, a sulfur atom, or a secondary amine;

Z is a straight chain alkane, a divalent organic group, aromatics or cycloaliphatic having 6 to 18 carbon atoms, and aliphatic groups having 1 to 10 carbon atoms; and $R_f$ is linear or branched fluoroalkyl having 4 to 6 carbon atoms;

wherein the non-fluorinated crosslinking monomer is the formula $H_2C{=}CACOOA'$, where A is a hydrogen atom or a methyl;

A' is an alkyl of the formula $C_nH_{2n+1}$, where n=3-30;

wherein the non-fluorinated branched monomer is the formula $H_2C{=}CACOOA'$, where A is a hydrogen atom or a methyl;

A' is branched primary to tertiary alkyl, and is of the formula $C_nH_m$, where n=3-10, m=7-30;

wherein the non-fluorinated crosslinking monomer has two or more reactive functional groups;

wherein the fluorine-free polymer is 30-70% by weight of the total of the water- and oil-repellant agent; the non-fluorinated non-crosslinking monomer of the fluorine-free polymer is 45-80% by weight of the total of the fluorine-free polymer; the non-fluorinated crosslinking monomer of the fluorine-free polymer is 1-30% by weight of the total of the fluorine-free polymer; and the olefin monomer of the fluorine-free polymer is 10-50% by weight of the total of the fluorine-free polymer; and wherein the fluorine-containing monomer of the fluorine-containing polymer is 45-80% by weight of the total of the fluorine-containing polymer; the non-fluorinated branched monomer of the fluorine-containing polymer is 1-30% by weight of the total of the fluorine-containing polymer; the non-fluorinated crosslinking monomer of the fluorine-containing polymer is 1-10% by weight of the total of the fluorine-containing polymer; and the olefin monomer of the fluorine-containing polymer is 10-50% by weight of the total of the fluorine-containing polymer.

2. The water- and oil-repellent agent of claim 1, wherein the non-fluorinated branched monomer is selected from of the group consisting of tert-Butyl methacrylate, iso-butyl methacrylate, 2-ethylhexyl methacrylate, n-nonyl acrylate, isobornyl acrylate, isobornyl methacrylate, cyclohexyl methacrylate, benzyl methacrylate, and benzyl acrylate.

3. The water- and oil-repellent agent of claim 1, wherein the non-fluorinated crosslinking monomer is selected from the group consisting of 3-chloro-2-hydroxypropyl methacrylate, 2-hydroxyethyl methacrylate, 2-hydroxypropyl methacrylate, epoxypropyl methacrylate, ethylene glycol methyl ether methacrylate, ethyl methacrylate, diacetone acrylamide, 4-hydroxybutyl acrylate, 1,4-cyclohexane dimethanol monoacrylate, and 4-hydroxybutyl acrylate glycidyl ether.

4. The water- and oil-repellent agent of claim 1, wherein the olefin monomer of the fluorine-free polymer is an olefin monomer.

5. The water- and oil-repellent agent of claim 1, wherein the olefin monomer is a vinyl chloride or a vinylidene chloride.

6. The water- and oil-repellent agent of claim 1, wherein the water- and oil-repellent agent is applied as a surface treatment agent for fiber products.

7. The water- and oil-repellent agent of claim 1, wherein the water- and oil-repellent agent is water-based.

8. The water- and oil-repellent agent of claim 7, wherein the water- and oil-repellent agent is applied as a surface treatment agent for fiber products.

* * * * *